US006682351B1

(12) United States Patent
Abraham-Fuchs et al.

(10) Patent No.: US 6,682,351 B1
(45) Date of Patent: Jan. 27, 2004

(54) METHOD AND SYSTEM FOR MONITORING THE POSTURE OF A USER AT A TRAINING APPARATUS

(75) Inventors: Klaus Abraham-Fuchs, Erlangen (DE); Thomas Birkhoelzer, Weisendorf (DE); Kai-Uwe Schmidt, Erlangen (DE)

(73) Assignee: Siemens Aktiengesellschaft, Münich (DE)

( * ) Notice: Subject to any disclaimer, the term of this patent is extended or adjusted under 35 U.S.C. 154(b) by 0 days.

(21) Appl. No.: 09/415,844

(22) Filed: Oct. 12, 1999

(30) Foreign Application Priority Data

Oct. 12, 1998 (DE) ..... 198 46 982

(51) Int. Cl.[7] ..... G09B 19/00; A63B 71/00
(52) U.S. Cl. ..... 434/247; 482/8; 482/901
(58) Field of Search ..... 434/247, 250, 434/252, 253, 254, 255, 258; 482/4, 6, 8, 9, 900, 901

(56) References Cited

U.S. PATENT DOCUMENTS

| | | | | | |
|---|---|---|---|---|---|
| 3,912,260 | A | * | 10/1975 | Rice | 272/57 B |
| 4,617,525 | A | * | 10/1986 | Lloyd | 340/573 |
| 4,697,808 | A | * | 10/1987 | Larson | 272/70 |
| 4,730,625 | A | * | 3/1988 | Fraser | 128/781 |
| 4,738,269 | A | * | 4/1988 | Nashner | 128/782 |
| 4,743,009 | A | * | 5/1988 | Beale | 272/69 |
| 4,906,192 | A | * | 3/1990 | Smithard | 434/254 |
| 4,958,145 | A | * | 9/1990 | Morris | 340/689 |
| 5,064,192 | A | * | 11/1991 | Smith | 272/125 |
| 5,168,264 | A | * | 12/1992 | Agustin | 340/573 |
| 5,243,998 | A | * | 9/1993 | Silverman | 128/782 |
| 5,337,757 | A | * | 8/1994 | Jain | 128/779 |
| 5,425,378 | A | * | 6/1995 | Swezey | 128/782 |
| 5,469,861 | A | * | 11/1995 | Piscopo | 128/781 |
| 5,570,301 | A | * | 10/1996 | Barrus | 364/559 |
| 5,697,791 | A | * | 12/1997 | Nashner | 434/247 |
| 5,792,031 | A | * | 8/1998 | Alton | 482/78 |
| 5,865,760 | A | * | 2/1999 | Lidman | 600/509 |
| 5,987,982 | A | * | 11/1999 | Wenman | 73/379.08 |
| 6,059,576 | A | * | 5/2000 | Brann | 434/247 |
| 6,116,640 | A | * | 9/2000 | Tanaka | 280/735 |
| 6,162,151 | A | * | 12/2000 | Tani | 482/54 |

FOREIGN PATENT DOCUMENTS

| | | |
|---|---|---|
| DE | OS 39 33 999 | 10/1989 |
| DE | OS 195 22 958 | 6/1995 |
| EP | 0 700 694 | 9/1994 |
| WO | WO 94/26359 | 5/1993 |

* cited by examiner

*Primary Examiner*—Kurt Fernstrom
(74) *Attorney, Agent, or Firm*—Schiff Hardin & Waite

(57) ABSTRACT

In a method and system for monitoring the posture of a user during the use of a training apparatus, sensors are attached to the body of the user and possibly to specific locations of the training apparatus for acquiring specific kinematic parameters. The measurement data acquired by these sensors is analyzed in an evaluating unit in order to detect a faulty motion or posture of the user during the use of the training apparatus and to emit a corresponding acknowledging message to the user or to the training apparatus in this case.

24 Claims, 1 Drawing Sheet

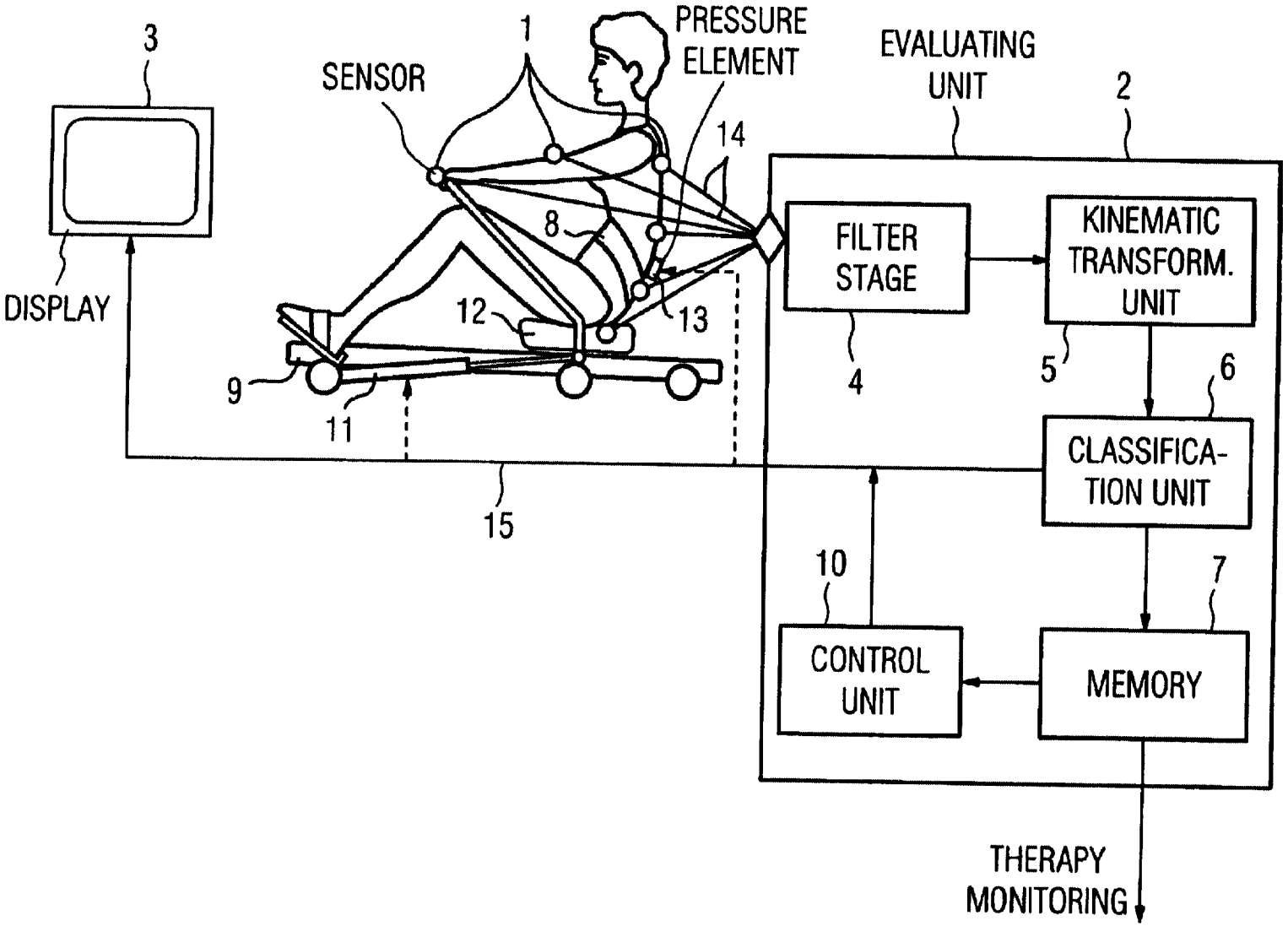
EVALUATING UNIT
2
KINEMATIC TRANSFORM. UNIT
5
6
CLASSIFICA-TION UNIT
7
MEMORY
THERAPY MONITORING
FILTER STAGE
4
10
CONTROL UNIT
PRESSURE ELEMENT
14
13
1
8
12
15
SENSOR
11
9
3
DISPLAY

METHOD AND SYSTEM FOR MONITORING THE POSTURE OF A USER AT A TRAINING APPARATUS

BACKGROUND OF THE INVENTION

1. Field of the Invention

The present invention relates to a method and a corresponding system for monitoring the posture of a user at a training apparatus, in order to guarantee that the user can achieve a desired training effect.

2. Description of the Prior Art

At a training apparatus such as a fitness or strength device, specific motions must be purposefully performed in order to achieve a desired training effect. If the user performs the motion differently or in an incorrect posture, not only is the desired training effect jeopardized, but serious injuries may even occur due to the over-stressing of joints, tendons, ligaments or muscles.

To eliminate this problem, users of training apparatuses are instructed in the use of the respective training apparatus by the personnel of the fitness studio, but this is rather expensive in terms of time and personnel. Furthermore, it is not guaranteed that the user will actually perform the training exercise correctly. Beyond this, it is known to prevent the abovementioned improper motions at a training apparatus by insuring that the respective motion is performed very precisely by means of corresponding mechanical constructions that are coupled with the training apparatus. These mechanical constructions, in the extreme case, prevent all motions which are not directed in the desired direction of motion. The constructions required for this purpose entail a high mechanical outlay.

Furthermore, European Application 0 700 694 teaches to provide a training apparatus with a sensor which enables a controlled and prescribed training as well as a diagnosis of the capabilities of the human locomotor system by evaluating the output data of the sensor by means of a computer, which displays a quantity that is derived from the output signals of the sensor to the user of the training apparatus simultaneous with the current motion.

PCT Application WO 94/26359 teaches registering and evaluating the motion of a joint in the context of gymnastic exercises that take place independently of a training apparatus, these exercises serve for rehabilitation, this being accomplished by means of a sensor that is attached to the patient. Only the number and range of the motions are registered.

Likewise independent of a training apparatus, German OS 195 22 958 teaches registering unique physical values of a subject via sensors, and conversion of the corresponding output signals into music that can be perceived by the subject.

It is also taught in German OS 39 33 999 to control the speed of the belt of a treadmill for physically stressing a subject wherein the position of a subject on the treadmill is detected by sensors, and the speed of the treadmill is increased or decreased according to the subject's position on the treadmill.

SUMMARY OF THE INVENTION

It is an object of the present invention to provide a method and a corresponding system with which the posture of the user during a training exercise at a training apparatus can be reliably monitored relatively easily, in order to be able to prevent injuries due to the over-stressing of joints, tendons, ligaments or muscles and to achieve the desired training effect.

The above object is achieved in accordance with the principles of the present invention in a method and an apparatus wherein at least one sensor is attached to the user of a training apparatus, the sensor detecting a kinematic parameter associated with the use of the training apparatus by the user, and wherein the kinematic parameter picked up by the sensor is evaluated in order to determine whether the user is exhibiting a faulty posture during use of the training apparatus.

In the inventive solution, the aforementioned mechanical motion guidance of the user is replaced by "virtual motion guidance". Using sensors, the motion of the user during the use of the training apparatus is monitored and evaluated, in order to be able to determine an improper posture by the user during the use of the training apparatus. To this end, in addition to sensors provided at the body of the user, additional sensors can be attached at specific locations of the corresponding training apparatus, which respectively detect kinematic parameters such as position, speed and acceleration. In particular, the sensors can be integrated into articles of clothing, belts or belt systems, so that it is easy to attach the sensors to the user's body.

For evaluating the acquired kinematic parameters, an evaluating unit such as a portable computer or a central unit which is attached to the training apparatus is provided, which processes the measuring data acquired by the sensors and emits a corresponding acknowledgment given the detection of an improper motion, or an improper posture of the user. This acknowledgment can occur optically or acoustically, for example.

Furthermore, it is also possible to inform the user of an improper posture directly by transmitting a corresponding signal that is discernable by touch, such as a pressure pulse or a vibration. It is likewise possible to realize the acknowledgment in the form of a mechanical intervention into the training apparatus, so that the training apparatus can be braked or blocked given an improper posture, for example.

The evaluating unit can include a memory in order to document the training of the user. It is also possible for the system to take over the function of training control, so that a specific exercise, or a specific number of exercises is prescribed to the user for training at the corresponding training apparatus.

An of the present invention is that the sensor mechanism used for monitoring the posture of the user at the training apparatus is small, simple to carry and inexpensive. High-outlay mechanical constructions are not used. This means both a cost advantage and a more comfortable use of the training apparatus for the user. Furthermore, the present invention also permits training units to be controlled that do not have sufficient mechanical guidance, such as cable-pull apparatuses. Using "virtual motion guidance," it is possible in principle to monitor random complex trajectories in space, such as combined rotary and longitudinal motions, in which mechanical constructions would usually reach their limits quickly. The prevention of injurious motions at training apparatuses is considerably improved with the aid of the present invention, so that injuries are reduced and a better training effect can be achieved.

DESCRIPTION OF THE DRAWINGS

FIG. 1 is a schematic illustration of a preferred exemplary embodiment of the inventive system.

DESCRIPTION OF THE PREFERRED EMBODIMENTS

FIG. 1 depicts a person performing a specific training exercise at a training apparatus 9. In this case, the training apparatus 9 is a rowing machine.

A number of sensors 1 are attached at the body of the person (the user), the sensors 1 respectively detecting specific kinematic parameters during the performance of the corresponding training exercise. The sensors 1 can be advantageously integrated into articles of clothing, belts or belt systems. In the example depicted in FIG. 1, one of these belt systems 8 is illustrated, one of these sensors 1 being integrated into the support 8 on the user's back. Belt systems of this type, which can be constructed in the fashion of mountain climbing belts in particular, can be easily worn by the user and do not hinder the user in the performing of the training exercise, or only slightly so. It is also possible to attach a few of these sensors 1 at specific locations of the training apparatus 9, in order to monitor motions during the performance of the training exercise at the training apparatus 9. For example, it is possible to monitor the motion of the seat 12 of the rowing machine, etc., using a corresponding sensor.

In general, sensors which are capable of detecting arbitrary kinematic parameters such as position values, speed values, or acceleration values can be used as the sensors 1. These kinds of sensors are generally known; for example, it is possible to use 3D ultrasound markers with an antenna, acceleration sensors, angle measuring systems, flexion sensors, stretch sensors or the like.

An evaluating unit 2 is provided for purposes of evaluating the measurement data registered by the sensors 1. This is preferably a portable computer or a central unit that is attached to the training apparatus 9, in order to minimize the space requirement for the inventive system.

The evaluating unit 2 receives the measurement data 14, picked up by the sensors 1, of the respectively monitored kinematic parameters, analyzes them, and it provides the user with an acknowledging message 15 about the user's posture, or about the motions he or she has performed, so that the user can correct his or her posture accordingly during the performance of the training exercise.

To this end, the evaluating unit 2 includes a filtering stage 4, which, if necessary, pre-processes the measurement data 14 captured by the sensor 1, so that the measuring data are, prepared for the subsequent evaluation. This filtering enables the elimination of disturbing influences that may arise during the transmission of the measurement data 14 from the sensors 1 to the evaluating unit 2. A transformation unit 5 that is connected to the filtering stage 4 performs a kinematic transformation of the received measurement data of the sensors 1, so that information is emitted by the unit 5 enabling actual conclusions to be reached about the motions performed by the user. This kinematic transformation can be forgone if the evaluation occurs directly by comparison of the measurement data picked up by the sensors 1 to a reference measurement data sample. To this end, the evaluating unit 2 receives preset measurement data, or a reference measurement data sample describing a perfect posture, or a perfect motion of the user, so that it is possible to reach a conclusion about the posture of the user directly by subsequently comparing the measurement data picked up by the sensors 1 to this preset reference measurement data sample. In addition, it is also possible for the evaluation, i.e., the assessment of the user's posture, to occur on the level of coordinates of specific points in space. In this case, the kinematic transformation by the unit 5 is necessary in order to convert the measurement data picked up by the sensors 1 into the coordinates information to be actually evaluated. For example, it is possible to reach a conclusion about the maximum curvature of the user's spinal column based on relative angle of specific sensors 1, or corresponding segments by means of the kinematic transformation of the unit 5.

The evaluating unit 2 also contains a classification unit 6 as a centralized component, which evaluates and classifies the information fed to it in order to ultimately reach a conclusion regarding the user's posture. The classification by the unit 6 can occur by known kinematic methods. In particular, the unit 6 can perform a pattern recognition or a model-based identification on the basis of neural networks or by applying fuzzy logic, in order to be able to judge the instantaneous posture of the user during the performing of the training exercise at the training apparatus 9.

The evaluating unit 2, or its classifying unit 6, is constructed such that, subsequent to the recognition of a faulty motion or faulty posture of the user, a corresponding effective acknowledgment 15 is immediately made available to the user, or to the training apparatus 9. To this end, the system illustrated in FIG. 1 has an optical display 3, which displays visual information about the instantaneous posture of the user and which may instruct the user to correct his or her posture. An acoustic output of the acknowledgment 15 is also possible via a speaker (not shown). It is particularly advantageous for the system illustrated in FIG. 1 to employ a tactile acknowledgment. To this end, pressure or vibration elements can be attached to the user, or at the training apparatus 9, which are activated given the determination of a faulty posture by the evaluating unit 2, in order to instruct the user by a pressure pulse, or by a corresponding vibration, to correct his or her posture. Pressure elements such as these can be arranged in a belt system, in the same manner as the sensors 1. FIG. 1 as an example depicts a pressure element 13 which triggers a pressure pulse on the user's back or spinal column given activation by the classifying unit 6, thus instructing the user to assume a straighter posture. It is also possible to provide the acknowledgment 15 of the classifying unit 6 or of the evaluating unit 2 in the form of a mechanical engagement of the training apparatus 9, so that given the determination of a faulty motion or a faulty posture of the user, it is possible to engage the training apparatus 9 mechanically, in order to brake or block the training apparatus 9. In this regard, FIG. 1 shows a dashed connection between the classifying means 6 and a hydraulic damping element 11 of the rowing machine apparatus 9, so that, by means a corresponding mechanical construction, it is possible to modify the resistance of this braking element 11, accordingly, depending on the evaluation result of the classifying unit 6.

The evaluating unit 2 illustrated in FIG. 1 also has a memory 7, which is provided for documenting the training sequence at the training apparatus 9. The information emitted by the classifying unit 6 about the posture and the motions of the user is stored in the memory 7. Furthermore, additional training information such as the number of training exercises, the duration of the training, the number of errors detected by the classifying unit 6, etc., are also stored in the memory 7. The information stored in the memory 7 is particularly appropriate for monitoring therapy in the course of a rehabilitation of the user, and thus it is preferably transmitted to a therapist. In addition, the information stored in the memory 7 can be evaluated for quality assurance.

Lastly, the system illustrated in FIG. 1 is also equipped with the function of training control. To this end, the evaluating unit 2 has a control unit 10, which gives the user specific training specifications, such as the number of training exercises to be performed, the current number of training exercises, speed information, performance information, training time information, etc., via the display 3.

The signal transmission 14 between the sensors 1 and the evaluating unit 2 as well as the transmission of the acknowledgment 15 from the evaluating unit 2 to the user preferably occur in a wireless manner. In particular, telemetric transmission is possible for all data streams between the sensor 1 and the evaluating unit 2, or between the evaluating unit 2 and the respective acknowledging component (in FIG. 1, the monitor 3, the pressure element 13, or the damping element 11 of the training apparatus 9), and between the evaluating unit 2, or the classifying unit 6 and the memory 7.

The present invention makes available an easily and inexpensively realizable capability to effectively monitor the posture of the user, or the motions he or she performs during the use of a training apparatus 9. The user's posture thus also can be reliably evaluated during complicated training exercises or motion sequences. The prevention of injurious motions and consequent injuries can be appreciably improved, and an improved training effect is possible.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for monitoring posture of a user at a training apparatus, comprising the steps of:

attaching at least one sensor to a user of a training apparatus which is physically operated by said user, said training apparatus having an apparatus part with a mechanical performance associated with said physical operation that is detectable by a user of the training apparatus during said physical operation of the training apparatus, said sensor detecting a kinematic parameter associated with said usage of the training apparatus by the user during said usage of the training apparatus;

evaluating only said parameter obtained by said sensor to determine if said user is exhibiting a faulty posture during use of said training apparatus; and informing said user of said faulty posture by altering said mechanical performance of said apparatus part during said physical operation.

2. A method as claimed in claim 1 comprising directly attaching a plurality of sensors to said user.

3. A method as claimed in claim 1 comprising attaching said at least one sensor to an article worn by said user.

4. A method as claimed in claim 1 comprising attaching a plurality of sensors to said training apparatus.

5. A method as claimed in claim 1 comprising selecting said sensor from the group of sensors consisting of position sensors, speed sensors and acceleration sensors.

6. A method as claimed in claim 1 wherein said sensor obtains measurement data representing said parameter, and comprising the additional step of comparing said measurement data to reference data to determine whether said user is exhibiting faulty posture.

7. A method as claimed in claim 6 comprising deriving coordinates of points in, space from said measurement data, and wherein said reference data represents reference points in space for comparison with said points represented by said measurement data.

8. A method as claimed in claim 1 comprising additionally informing said user of said faulty posture by transmitting an indicator of faulty posture to said user as wireless information signals.

9. A method as claimed in claim 8 comprising selecting said wireless information signals from the group of signals consisting of optical signals and acoustic signals.

10. A method as claimed in claim 1 comprising additionally informing said user of said faulty posture by transmitting an indicator of said faulty posture to said user as a tactilely perceptible signal.

11. A method as claimed in claim 1 comprising storing a result of said evaluation.

12. A method as claimed in claim 1 wherein said sensor obtains measurement data, and comprising the step of wirelessly transmitting said measurement data to a location remote from said user for evaluating said measurement data.

13. A system for monitoring posture of a user at a training apparatus, comprising:

at least one sensor adapted for attachment to a user of a training apparatus which is physically operated by said user, said training apparatus having an apparatus part with a mechanical performance associated with said physical operation that is detectable by the user, said sensor detecting a kinematic parameter associated with said physical operation of the training apparatus by the user during said physical operation of the training apparatus; and an evaluation unit for evaluating only said parameter obtained by said sensor to determine if said user is exhibiting a faulty posture during said physical operation of said training apparatus and for informing said user of said faulty posture by altering said mechanical performance of said apparatus part during said physical operation.

14. A system as claimed in claim 13 comprising a plurality of sensors adapted for direct attachment to a user.

15. A system as claimed in claim 13 comprising an article adapted to be worn by a user, to which said at least one sensor is attached.

16. A system as claimed in claim 13 comprising a plurality of sensors attached to said training apparatus.

17. A system as claimed in claim 13 wherein said at least one sensor is selected from the group of sensors consisting of position sensors, speed sensors and acceleration sensors.

18. A system as claimed in claim 13 wherein said sensor obtains measurement data representing said parameter, and wherein said means for evaluating comprises means for comparing said measurement data to reference data to determine whether said user is exhibiting faulty posture.

19. A system as claimed in claim 18 wherein said means for evaluating comprises means for deriving coordinates of points in space from said measurement data, and wherein said reference data represents reference points in space for comparison with said points represented by said measurement data.

20. A system as claimed in claim 13 wherein said means for evaluating additionally generates an indicator to inform said user of said faulty posture, and wherein said system comprises comprising a wireless transmitter for transmitting said indicator as wireless information signals.

21. A system as claimed in claim 20 wherein said wireless transmitter is selected from the group consisting of optical transmitters and acoustic transmitters.

22. A system as claimed in claim 13 wherein said means for evaluating additionally generates an indicator to inform said user of said faulty posture, and wherein said system comprises means for transmitting said indicator to said user as a tactilely perceptible signal.

23. A system as claimed in claim 13 wherein said means for evaluating comprises a memory for storing a result of said evaluation.

24. A system as claimed in claim 13 wherein said sensor obtains measurement data, and comprising means for wirelessly transmitting said measurement data to a location remote from said user at which said means for evaluating is disposed.

* * * * *